US005503711A

United States Patent [19]

Salminen

[11] Patent Number: 5,503,711

[45] Date of Patent: Apr. 2, 1996

[54] METHOD OF REHABILITATING A WOOD PULP DIGESTER

[76] Inventor: Reijo Salminen, 373 Cove Rd., Bellingham, Wash. 98226

[21] Appl. No.: 259,513

[22] Filed: Jun. 14, 1994

[51] Int. Cl.[6] ..... D21C 7/00; D21C 7/02

[52] U.S. Cl. ..... 162/48; 162/272; 162/237; 162/233; 29/402.09; 29/402.18; 29/402.19; 220/470; 220/454; 220/408; 206/524.4; 264/36; 422/8; 422/241; 52/514; 52/514.5; 52/516

[58] Field of Search ..... 162/48, 272, 237, 162/233; 29/402.09, 402.14, 402.16, 402.18, 402.19; 220/470, 454, 408; 206/524.4; 148/110; 156/94, 98, 71; 264/36; 52/514, 514.5, 516, 728, 248; 422/8, 241

[56] References Cited

U.S. PATENT DOCUMENTS

| | | | |
|---|---|---|---|
| 483,826 | 10/1892 | Brüngger | 162/48 |
| 609,733 | 8/1898 | Coker, Jr. | 162/48 |
| 1,911,608 | 5/1933 | Davis et al. | 220/426 |
| 2,022,378 | 5/1935 | Lacy et al. | 220/454 |
| 2,235,937 | 3/1941 | Linberg | 264/36 |
| 5,236,750 | 8/1993 | Duret et al. | 206/524.4 |
| 5,337,914 | 8/1994 | Mulder | 220/403 |

*Primary Examiner*—David L. Lacey
*Assistant Examiner*—Jose A. Fortuna
*Attorney, Agent, or Firm*—Hughes, Multer & Schacht

[57] ABSTRACT

A method of rehabilitating a wood pulp digester, comprising applying to an interior surface of the digester wall a tacky silicone rubber layer, and then applying vertical strips of metallic sheet material to form a composition layer of said silicone rubber and said metal strips.

7 Claims, 2 Drawing Sheets

METHOD OF REHABILITATING A WOOD PULP DIGESTER

The present invention relates to a method and apparatus for rehabilitating a containing structure which is subject to deterioration due to corrosive action or some other cause, and more particularly relates to rehabilitating a containing structure of a digester for a wood pulp mill.

BACKGROUND OF THE INVENTION

In pulp mills, there is a digester, into which wood chips and a processing liquor are directed to be processed under conditions of high temperature and pressure. Generally, the digester comprises a quite large metallic container, with the walls of these containers having sufficient thickness and material strength to withstand these high pressures. Eventually, the liquor within the digester causes corrosion of the interior surface of the containing structure. This causes a weakening of the containing structure, and eventually, this requires the digester to be operated at lower temperatures and pressures. After a period of time, however, it becomes necessary either to replace the digester or to rehabilitate the digester so that it could be operated at the higher temperatures and pressures which enable the digesting process to be carried on more efficiently.

The usual method of accomplishing this is to shut-down the digester, empty the digester, and then reline the interior surface of the digester. This is commonly accomplished by welding metal beads along the entire inside surface of the digester to build up the thickness of the digester wall. This is an expensive, time consuming process, sometimes taking several weeks or more. Further, this can result in a prolonged shutdown of the mill, causing a very substantial loss of revenue.

Accordingly, there has for decades been a requirement for an improved means of rehabilitating such digesters.

SUMMARY OF THE INVENTION

The method of the present invention provides the means of rehabilitating a containing structure having an interior surface which has been subjected to corrosive action. This method is particularly adapted for rehabilitating the containing structure of a digester in a pulp mill.

The method comprises applying a layer of a flowable silicone rubber composition to an interior surface of a containing structure, with a layer being in a tacky condition so as to have an adhering surface.

Then there is applied to this silicone rubber layer a plurality of metallic strips of corrosion resistant metal, with the strips having adjacent generally vertically aligned edge portions. The silicone rubber is permitted to harden in the manner to form a composite layer having a corrosion resistant interior surface.

In one embodiment, the strips comprise stainless steel strips of screen material, with edges overlapping. In another embodiment, the strips are impervious strips of stainless steel in overlapping relationship.

In one embodiment, after the interior composite layer is applied, a reinforcing material is applied around the outer surface of the containing structure. In a specific application, the containing structure is a wood pulp digester. Also, in a preferred form of the method the digester is operated while the outer material is being applied.

The invention also comprises a rehabilitated containing structure made in accordance with this invention.

Other features will become apparent from the following detailed description.

DESCRIPTION OF THE PREFERRED EMBODIMENT

Figure 1:
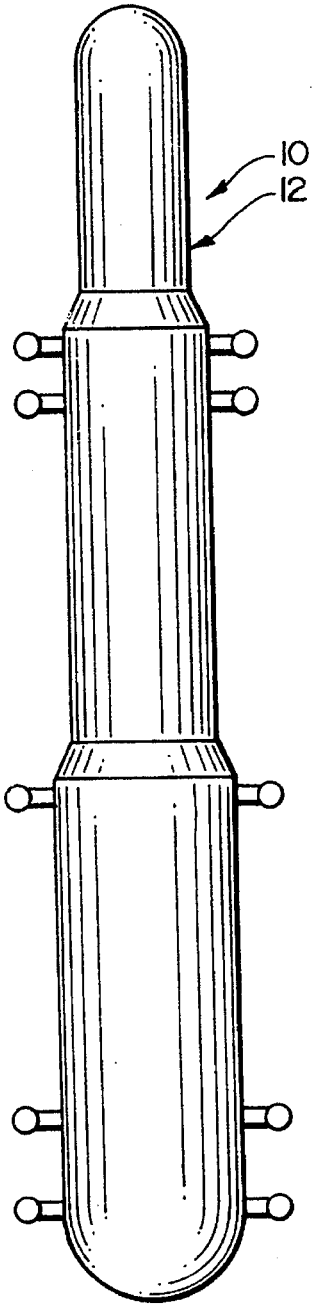
FIG. 1 is a somewhat schematic side elevational view of a digester adapted for utilization of the present invention.

In FIG. 1, there is shown a digester 10, comprising a vertically aligned containing structure 12 (commonly called a "tower"). The wood chips and processing liquor are commonly introduced into the upper end of the containing structure 12, and these are contained in the structure 12 under high temperatures and pressure as high as approximately 165 PSI. The container 12 has a metallic walls and it must be of sufficient thickness and material strength to withstand the high pressures generated within the structure 12. These digester containing structures 12 are generally made under rather stringent inspection requirements to ensure their quality and the integrity of the structure. Further, any repairs, reconstruction or rehabilitation must be done under rather stringent quality control requirements to ensure the safe operation of the digester.

Figure 4:
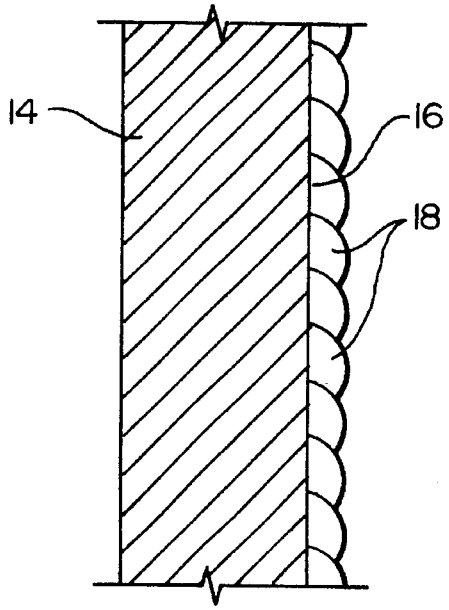
FIG. 4 PRIOR ART
FIG. 4 is a horizontal sectional view taken through a portion of a wall of the containing structure of a digester illustrating a prior art method of applying a metallic reinforcing material to the inside surface of the digester.

It is believed that a better appreciation of the present invention will be obtained by first describing briefly the common prior art manner in which these digesting structures 12 are relined or rehabilitated. With reference to FIG. 4, there is shown a portion of the wall 14 of the containing structure 12. Let it be assumed that over a period of time the inside surface 16 of the wall 14 has been subjected to the corrosive action of the chemicals within the digester 10 so that this inside surface has worn away so as to reduce the material thickness of the wall 14, and possibly cause irregularities and general deterioration of the inside surface 16.

As indicated previously, the common prior art method of effecting the repair is to first clean the inside surface 16 and then somewhat laboriously apply elongate welded metal beads over the entire inside surface 16. Depending upon the added thickness desired for the wall 14, possibly several layers of welded beads might be placed over the inside surface. One of the significant considerations in increasing the thickness of the wall by bonding additional metal to the wall is to improve the structural integrity of the overall metal structure with respect to the ability to withstand the high pressures developed within the digester. Nevertheless, this laborious application of the row upon row of the weld beads is an expensive and time consuming process.

Figure 3:
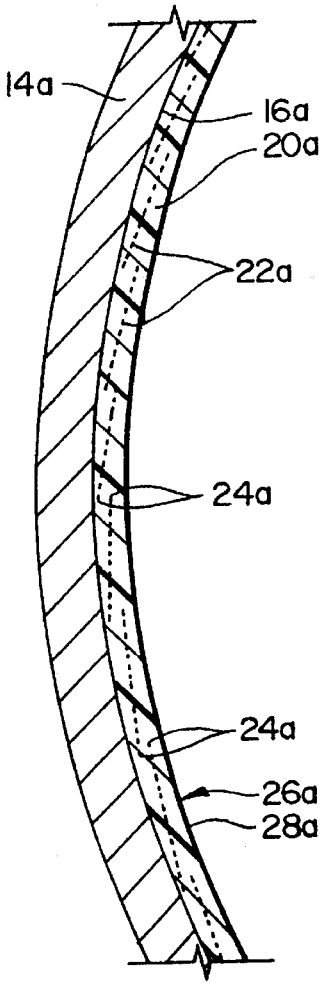
FIG. 3 is a horizontal sectional view similar to FIG. 2, showing a second embodiment of the present invention.

To describe the first embodiment of the present invention reference is made to FIG. 3 which shows a portion of a digester wall 14 having an inside surface 16. As an initial step, the inside surface 16 is cleaned so as to remove dirt, moisture, and other possible contaminant. Then a silicone rubber sealant composition is spread over the inside surface 16. A silicon rubber sealant which is particularly adapted for use in this application is marketed by General Electric Company under the mark or designation RTV 6703. The formulation for this composition is listed as having the following:

methoxypolydimethylsiloxane 68037-58-1;

polydimethylsiloxane 63148-62-9;

an ingredient listed as trade secret registry 11473014-5092; and methyltrimethoxysilane 1185-55-3

The silicone rubber sealant is applied as a rather viscose, somewhat flowable material which is "tacky" for a short period of time after initial application. It has sufficient viscosity that it will adhere to the vertical wall surface as a layer, indicated at 20. Prior to the silicone rubber sealant material losing its tackiness and hardening, strips 22 of stainless steel metal screen are applied to the silicone rubber materials, and a further layer of silicone rubber material is applied over the screen strips to form a composite layer 26.

As can be seen in FIG. 3, the stainless steel screen material 20 are vertically aligned, and edge portions 24 of the screen material strips 22 overlap to some extent. Thus, the entire deposited layer 22 of the silicone rubber has stainless steel screen material imbedded with it. This overlapping pattern of steel screen permits the composite layer 26 to expand laterally when it is subjected to the high pressure within the digester.

The silicone rubber material 20 has sufficient structural stability so it remains in place adhereing to the inside surface 16 of the vertical wall 14. After about 24 hours the rubber sealant is substantially completely cured. Both the cured silicone rubber sealant and the stainless steel are able to withstand temperatures up as high as 400° F. (higher than would usually be encountered in the digester) and also can withstand the pressures within the digester (often as high as 165 PSI).

Further, both the silicone rubber sealant and the stainless steel are resistant to corrosion of the chemicals in the processing liquor used in the digester 12.

Subsequent to the application of the silicone rubber/stainless steel screen composite being installed, and after the digester 10 is put into use, over a period of time there will be a certain amount of wear at the inside surface 28 of the silicone rubber layer. As this occurs, the stainless steel screen material will become exposed to the liquor and the wood chips in the digester. The stainless steel material has sufficient structural strength so as to be resistant to further abrasive action of the wood chips or corrosive action of the liquor so that this would impede further material removal from the composite layer 26. Obviously several layers of silicone rubber and metal screen could be applied.

The second embodiment of the present invention is shown in FIG. 3. Components of the second embodiment which are similar to components of the first will be given like numerical designations with an "a" suffix distinguishing these from the first embodiment. The second embodiment is rather similar to the first embodiment in that it uses the same silicone rubber composition to form the layer **20*a* and also uses the stainless steel screen strips 22*a*. The main difference in the second embodiment is that the screen strips 22 are arranged so that the one edge portion 24*a* of any single strip 22 is beneath the adjacent overlapping portion 24*a* of an adjacent screen stripe 22*a*. However, its other edge portion 24*a* overlies another adjacent edge portion 24*a*. Thus, the overlapping relationship of these strips 22*a* is more in the nature of the overlapping edges of a stack of cards which is spread out laterally over a card table so that the edge portions of the cards overlap to some extent. In other respects, the operation and function of the composite layer 26*a*** of the second embodiment is quite similar to the composition layer of the first embodiment.

Figure 2:
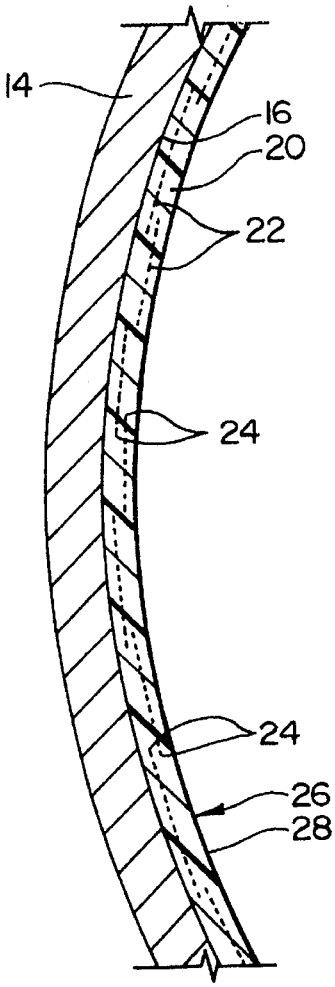
FIG. 2 is a horizontal sectional view of a portion of the wall of the containing structure of the digester, illustrating a first embodiment of the present invention.
Figure 5:
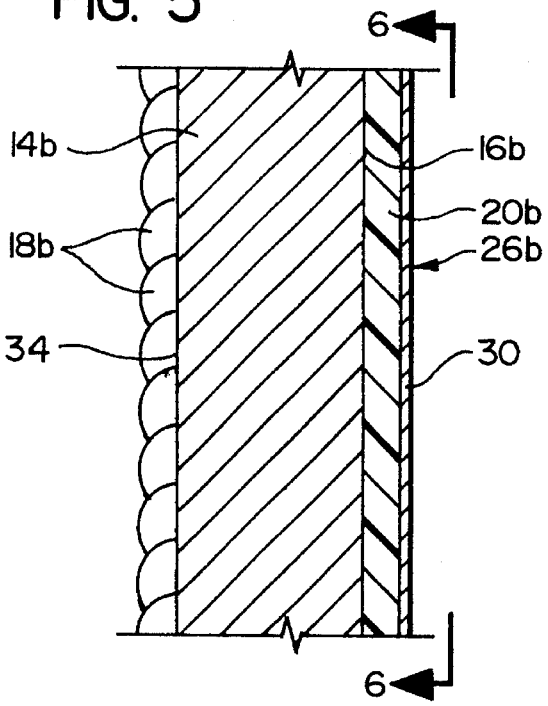
FIG. 5 is a sectional view similar to FIG. 4, illustrating a third embodiment of the present invention.
Figure 6:
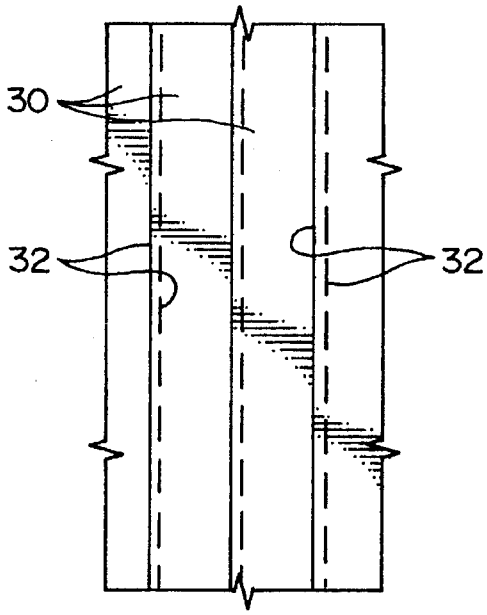
FIG. 6 is a view taken at location 6—6 at FIG. 5, looking toward the inside wall surface.

A third embodiment will now be described with reference to FIGS. 5 and 6. Components in this third embodiment which are similar to components of the other embodiments will be given like numerical designations, with a "b" suffix distinguishing those of the third embodiment. In this third embodiment, there is the digester wall **14*b* having an inside surface 16*b*. The first step is to clean the inside wall surface 16 as described above. Then the next step is to apply the silicone rubber sealant layer 20 in the manner described previously relative to the first two embodiments. Then thin flexible substantially impervious sheets strips 30 of stainless steel metal are vertically aligned and placed against the inside surface of the silicone rubber layer 20*b*. As can be seen if FIG. 6, the edge portions 32 of the sheets 30 overlap each other slightly. The overlapping relationship can be accomplished in either of the ways shown in FIGS. 2 and 3. In other words, one of the strips 30 could have both of its edges 32 overlying both adjacent edges 32 of the adjacent strips 30, or each strip 30 could have one edge portion 32 lying beneath an adjacent edge portion 32 and the other overlying the other adjacent edge portion 32 (as in FIG. 3**).

The stainless steel metal strips are applied within a reasonably short time frame after the silicone rubber layer **20*b* is applied so that these strongly adhere to the silicone rubber layer 20*b* after it hardens. The stainless steel impervious strips 30 form a low friction, wear resistant surface to resist abrasion by possibly rubbing contact with particulates (e.g. wood chip pieces) and also are resistant to corrosion. Further, the silicone layer 20*b* would be resistant to corrosion from the digesting liquor that might leak adjacent edges 32 of the strips 30 to come in contact with the silicone rubber layer 20*b***.

After the application of the composite layer **26*b*, the digester can be placed back in operation. However, if the thickness of the digester wall 14*b* has decreased due to corrosion so that the digester must be operated at lower pressures, it would of course be desirable to increase the material thickness of the wall 14*b* so that it could withstand higher pressures. If so, then after the digester has been placed back in operation, further metal material could be applied and bonded or welded to the outer surface 34 of the wall 14*b*. This could be accomplished, for example, in the prior art manner of welding beads of metal 18*b* to the outer surface 34. Since the addition of welded beads 18*b*** is a rather time consuming process which could extend over several weeks, the ability to accomplish this while the digester is already in operation provides a significant benefit.

It is obvious that various modifications could be made to the present invention without departing from the basic teachings thereof.

What is claimed:

1. A method of rehabilitating a containing structure having an interior surface which has been subjected to corrosive action, said method comprising:

a. applying a layer of a curable flowable silicone rubber composition to said interior surface of said containing structure with the layer being in a tacky condition so as to have an adhering surface;

b. applying to said silicone rubber layer metallic strips of corrosion resistant metal with said strips having adjacent edge portions that extend downwardly, c. permitting said silicone rubber layer to cure and harden in a manner to form a composite layer comprising said metallic strips bonded to said silicone layer and having a corrosion resistant interior surface.

2. The method as recited in claim 1, wherein said strips comprises stainless steel strips of screen material having openings therein, with edges of said strip being in overlapping relationship.

3. The method as recited in claim 1, wherein said strips are strips of stainless steel without openings in overlapping relationship.

4. The method as recited in claim 1, wherein after said composite layer has been applied to said inner layer of said containering structure, reinforcing material is applied around the outer surface of said containing structure so as to increase material thickness and strength of said containing structure.

5. The method as recited in claim 4, wherein said containing structure is a wood pulp digester that has been subjected to corrosive action of digesting liquor.

6. The method as recited in claim 5, wherein said digester is placed into operation after said inner composite layer has been applied, and during operation of said digester, the outer layer of reinforcing material is applied to the outer surface of the digester.

7. The method as recited in claim 1, wherein said containing structure is a wood pulp digester which has been subjected to corrosive action by digesting liquor within the containing structure.

* * * * *